United States Patent [19]

Gross

[11] 4,166,355

[45] Sep. 4, 1979

[54] CABLE AND METHOD AND DEVICE FOR PRODUCING SAME

[76] Inventor: Friedbert Gross, 8601 Weissenberg i. Sa., August-Bebel-Platz 7, German Democratic Rep.

[21] Appl. No.: 914,115

[22] Filed: Jun. 9, 1978

[30] Foreign Application Priority Data

Jun. 17, 1977 [DD] German Democratic Rep. ... 199563

[51] Int. Cl.[2] ..... D07B 1/16; D02G 3/48

[52] U.S. Cl. ..... 57/212; 57/6; 57/260; 57/902

[58] Field of Search ..... 57/3, 6, 9, 13, 14, 57/139, 144, 146, 147, 148, 153, 156, 160, 161, 166, 200, 210, 212, 214, 215, 217, 219, 235, 260, 902

[56] References Cited

U.S. PATENT DOCUMENTS

| | | | |
|---|---|---|---|
| 2,136,865 | 11/1938 | Reed | 57/147 |
| 2,136,866 | 11/1938 | Reed | 57/147 |
| 2,241,955 | 5/1941 | Noyer et al. | 57/219 X |
| 3,018,607 | 1/1962 | Dietz et al. | 57/148 |
| 3,391,530 | 7/1968 | Lex | 57/214 |
| 3,425,207 | 2/1969 | Campbell | 57/161 X |

*Primary Examiner*—Donald Watkins
*Attorney, Agent, or Firm*—Allison C. Collard; Thomas M. Galgano

[57] ABSTRACT

A cable for the reinforcement of plastic and elastic articles, such as conveyor belts and the like, is provided which includes a plurality of metal strands which are twisted to form a cable and a non-metallic insert which is disposed between the surfaces of the strands which oppose each other so as to prevent the strands from contacting each other, while leaving the surfaces of the strands which define the outside diameter of the cable exposed. A method and device for producing the cable is also provided.

15 Claims, 5 Drawing Figures

CABLE AND METHOD AND DEVICE FOR PRODUCING SAME

BACKGROUND OF THE INVENTION

Cables made of metal wire for the reinforcement of plastic and elastic articles are known. These cables essentially consist of strands made from single wires. The strands, with or without a core, are twisted together to form a cable. However, there are also cables known, the strands of which, before they are twisted together, are twisted around or wrapped in textile fibers. The cables, the strands of which are twisted around with textile fibers, have a relatively high flexibility, but have, relative to the diameter of the cable, a relatively low tensile strength. Cables made of strands that are not wrapped in textile fibers, on the other hand, have a relatively high tensile strength and a relatively low flexibility.

The known cables made of metal wire are used to reinforce plastic and elastic articles and especially conveyor belts. The mechanical properties e.g. of the conveyor belts are essentially determined by the cables that have been inserted to reinforce it, whereby these stretch in the longitudinal direction of the conveyor belt, with spaces between them.

Conveyor belts with cables that have strands without textile fibers have, relative to the diameter of the cable, a relatively high tensile strength but, unfortunately, a relatively low flexibility.

Conveyor belts that have cables with strands that are wrapped around with textile fibers, on the contrary, have a relatively high flexibility and a low tensile strength, calculated on the diameter of the cable. These conveyor belts have a relatively low metallic cross section.

Furthermore, a cable made of metal wire is known, in which the strands are placed around a single plastic core, whereby the plastic core has flanges that protrude outward. These flanges protrude clearly beyond the circumference of the strands in order to reach certain friction values between the guide rollers and the cable. For the production of these cables a relatively high foregoing effort is required, as well as greater consumption of material. Moreover, this cable exhibits a relatively low flexibility and a relatively large outside diameter.

Cables of metal wire with non-wrapped strands are made on known cable-making machines, whereby the strands are pulled off from reels, are gathered together in the twisting head of the cable-making machine and are there twisted into a cable. Cables with wrapped strands are made in the same way, whereby strands are pulled off the reels, which strands are already wrapped in textile fibers.

OBJECTS OF THE INVENTION

It is therefore an object of the invention to provide a cable of metal wire for the reinforcing of plastic and elastic articles and a method and device for its production, which improves the utility of the plastic and elastic article in which it is incorporated and which exhibits a relatively longer service life.

It is a more particular object of the invention to provide a cable of metal wire for the reinforcement of plastic and elastic articles, especially of conveyor belts, and to provide a method and device for its production which results in high strength properties and high flexibility of the plastic and elastic articles, especially conveyor belts, as well as a good endless connection and impact resistance of the same.

SUMMARY OF THE INVENTION

According to the invention, these objects are attained by the provision of a cable which is characterized by the fact that, between the opposed surfaces of the strands and the core, an insert is placed which eliminates the reciprocal touching of the same. The insert consists of multiple part, non-metallic deposits, which do not cover the surfaces of the strands that form the outer diameter of the cable.

It is preferable that the insert consist of at least two non-metallic textile strips.

It is further preferable that the number of the strips is the same as the number of the strands and that each strand is partly covered by a strip.

It is also advantageous that if, when the number of strands is even, the number of strips is equal to half the number of the strands and that the strands are alternately partly covered.

In a further embodiment of the invention, it is advantageous to provide a method for the production of the cables, which is characterized in that the multiple non-metallic inserts are pulled off from reels and are, in a predetermined manner, placed on the strands at a predetermined distance from the cable twisting head and that the strands, together with the inserts placed on them, are then fed to the cable twisting head and are there twisted into a cable.

Thereby, it is possible that the inserts, that are formed by at least two non-metallic strips, are fed to the cable twisting head. Preferably, a strip is applied to each strand or to each second strand.

According to the invention, it is also preferable that the insert is fed to the strands through an aperture proficed for the introduction of the core.

It is particularly advantageous that the insert is placed on the strands at a distance of 20 to 150 mm from the cable twisting head.

In yet a still further embodiment of the inventor, a device is provided for producing the cable which is characterized by the provision of guide plates that feed in the non-metallic strips and are placed before the cable twisting head. The shape of the guide plates correspond substantially to the shape of the opposed section of the surface of the associated strand.

Most desirably, the distance between the guide plates and the cable twisting head amounts to 20 to 150 mm. Preferably, the number of guide plates is the same as the number of the strips that have to be applied. Most advantageously, the guide plates surround the edges of the strips by means of guiding edge areas.

The advantages of the invention lie, in particular, in the creation of a cable of metal wire which, calculated on the diameter of the cable, has high strength characteristics as well as high flexibility.

These cables can to advantage be used in the construction of conveyor belts in which between the metallic cross-sections of the single cable only a minimum quantity of rubber is applied that is necessary, as is always the case in those conveyor belts that have to satisfy the highest demands for strength.

Another advantage of the invention is that the device according to the invention can be attached to a known cable spinning machine, so that there will be only very low change-over costs.

Furthermore, it is of advantage that the endless connections of e.g. the conveyor belts are more secure. In the increase in the rupturing strength of the conveyor belt and the decrease in the springy action of the cable in such cables, considerable advantages of the invention can be found.

DETAILED DESCRIPTION OF THE ILLUSTRATED EMBODIMENT

Figure 1:
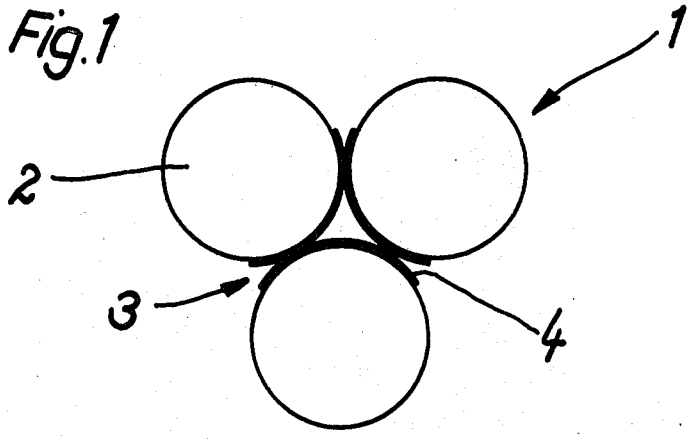
FIG. 1 is a schematically-illustrated cross-sectional view of a three-strand cable of metal wire provided with an insert.

As shown in FIG. 1, a cable 1 is provided composed of three strands 2 and a multi-part, non-metallic insert 3. Strands 2 consist of a single metallic wire. Insert 3 is so placed between strands 2 that a mutual touching of strands 2 is impossible; insert 3 being made of three strips 4. Because a mutual touching of the surfaces of strands 2 is impossible, a mutual displacement of strands 2 vis-a-vis each other is possible, so that a high flexibility of cable 1 is reached.

It is important that the areas of strands 2, i.e., the area of their surfaces, which form the outer diameter of the cable 1, are not covered by strips 4, because of which only a relatively slighter, larger outer diameter of the cable 1 is attained.

Cable 1 can, because of its relatively small outer diameter, be inserted in conveyor belts that are meant for the highest tensile strength, whereby the space between the metallic cross-section of the cable 1, as e.g. in conveyor belts of the so-called "x-series," may only be minimal.

Figure 2:
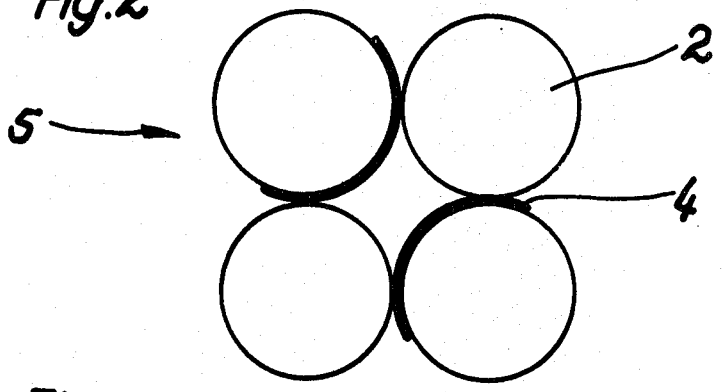
FIG. 2 is a schematically-illustrated cross-sectional view of a four-strand cable provided with an insert.

In the cable 5 shown in FIG. 2, there are four strands 2 twisted together; between these, insert 3, consisting of two strips 4, is placed. Each second strand 2 is thereby partly surrounded by one of strips 4.

In principle, each of strands 2 of cable 1 can be partly surrounded by a strip 4. Consequently, there would then always be two strips 4 between the opposed surfaces of strands 2.

However, it is also in principle possible, with an even number of strands 2, to surround only each second one of strands 2 partly with one of strips 4. Hence, in this case, at any time only one of strips 4 is placed between two strands 2.

Strips 4 can be made of practically any non-metallic textile and also of plastic. They must have a relatively low adhesion to metal and a sufficient non-abrasive quality. But it is also possible that only bundles of fibers are placed between strands 2. These, too, just like strips 4, must exclude any mutual touching of the strands 2.

Figure 3:
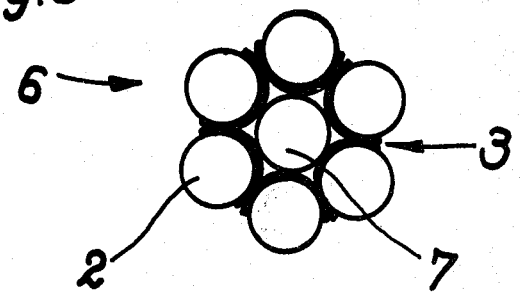
FIG. 3 is a schematically-illustrated cross-sectional view of a six-strand cable provided with an insert and a core.
Figure 5:
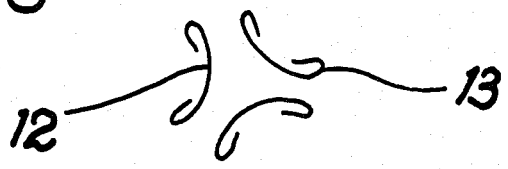
FIG. 5 is a schematically-illustrated end view of the guide plates for the production of the cable according to FIG. 1.

Insert 3, which consists of strips 4, can also be used in cables 6 that have a core 7 (FIG. 3). As a result, insert 3 also prevents the touching of strands 2 and core 7. This is especially important when the cable 6 has a metal core. Thus, if cable 5 (FIG. 2), which has an even number of strands 2, is made with a metallic core, each of strands 2 must be partly surrounded with one of strips 4.

Figure 4:
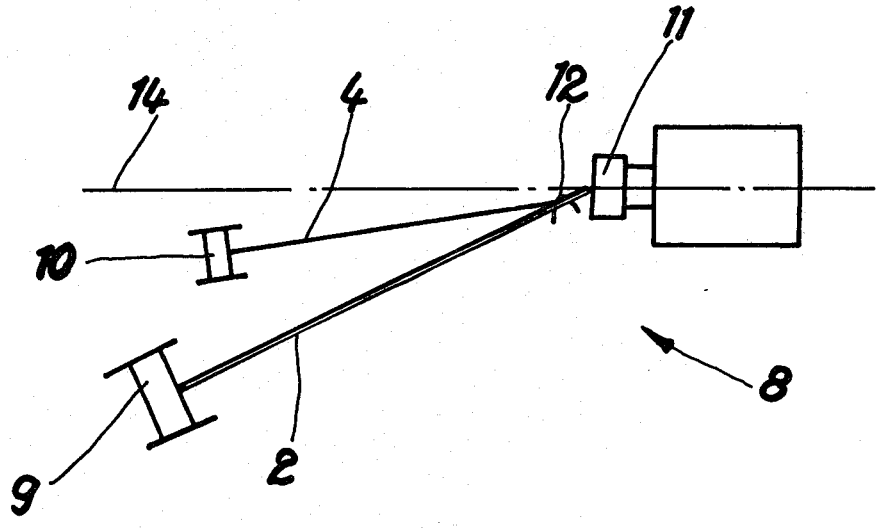
FIG. 4 is a schematic representation of a cable-making machine provided with a device for the guidance of the non-metallic strips, illustrated in part.

Cables 1, 5, and 6 of metallic wires are made on a known cable spinning machine 8 (FIG. 4). This cable spinning machine 8 has reels 9 for the strands 2 and reels 10 for the strips 4; FIG. 4 shows diagrammatically only one of each of the reels 9 and 10. Strands 2 are pulled off reels 9 in a known manner and led to a cable twisting head 11. At the same time, strips 4 are pulled off reel 10 and are likewise led to cable twisting head 11. Just before cable twisting head 11, strips 4 are so placed on strands 2 that, after the twisting, they take up for example the position shown in FIG. 1. To attain this sure and undistorted placing of strips 4, they are guided just before the cable twisting head 11 by the guiding plates 12, which have essentially the shape of the opposite sections of the surface of the strand 2 belonging to it. Guiding plates 12 are relatively short, and are placed preferably between 20 and 150 mm, before the cable twisting head 11, so that strips 4, after they have passed guiding plates 12, cannot leave their predetermined position for the twisting strands 2.

For a better guidance, guiding plates 12 have edge areas 13 on both sides which surround the edges of strip 4. Because the bow-shaped distance on these edge areas 13 is only a little greater than the width of strip 4, an exact and precise guidance of the strip 4 is attained.

As can be seen in FIG. 4, reels 10 are coordinated with reels 9 and the guiding plates 12, i.e., relatively near to an axis 14 of the cable spinning machine 8. The number of guiding plates 12 and reels 10 is determined by the number of strips 4 that are to be placed.

In the production of the cables 1, 5, and 6, it is also possible that strips 4 are led to cable twisting head 11 through the aperture provided for the core 7. In the case when a core 7 is provided, strips 4 together with core 7 can be led to the cable twisting head 11 through this aperture.

While only several embodiments of the present invention has been shown and described, it will be obvious to those persons of ordinary skill in the art that many changes and modifications may be made thereunto without departing from the spirit and scope of the invention.

What is claimed is:

1. A cable for the reinforcement of plastic and elastic articles, such as conveyor belts and the like, comprising:
   - a plurality of metal strands which are twisted to form a cable; and
   - a non-metallic insert which comprises at least two flexible flat, sheet-like strips which are thin relative to said strands, and which is disposed between the surfaces of the strands which oppose each other so as to prevent said strands from contacting each other, said insert leaving the surfaces of said strand which define the outside diameter of the cable exposed.

2. The cable according to claim 1, wherein said insert comprises at least two non-metallic textile strips.

3. The cable according to claim 1, wherein said insert comprises at least two strips of plastic.

4. The cable according to claim 2, wherein the number of said strips is the same as the number of said strands and that each strand is partly surrounded by one of said strips.

5. The cable according to claim 2, wherein an even number of strands is provided, wherein the number of said strips is equal to half the number of said strands and wherein only every other of said strands is partially surrounded by one of said strips.

6. The cable according to claim 1, wherein said plurality of metal strands are twisted about a core and wherein said insert also prevents said strands from contacting said core.

7. A method for the production of a cable for plastic and elastic articles such as conveyor belts and the like, which includes a plurality of metal strands which are twisted together to form a cable and a non-metallic insert which is disposed between the surfaces of the strands which oppose each other to prevent the strands from contacting each other while leaving the surfaces of the strands which define the outside diameter of the cable exposed, comprising the steps of:

pulling the metal strands off reels; and feeding them together with the insert in a predetermined unchanging position to a cable twisting head which twists the wires with the insert disposed therebetween to form said cable, said insert being formed by at least two non-metallic, flexible, flat strips which are thin relative to said strands, which are fed to said cable twisting head.

8. The method according to claim 7, wherein said insert comprises a plurality of strips, each of which is placed against one of said strands during said feeding step.

9. The method according to claim 7, wherein said insert comprises a plurality of strips, each of which is placed against each second strand during said feeding step.

10. The method according to claim 7, additionally including the steps of feeding a core through an aperture to said cable twisting head and twisting said strand about said core and wherein said insert is fed through said aperture together with said core to said cable twisting head.

11. The method according to claim 7, wherein said insert is placed against said strands at a distance of 20 to 150 mm from said cable twisting head.

12. A device for the production of a cable for plastic and elastic articles such as conveyor belts and the like, which includes a plurality of metal strands which are twisted together to form a cable and non-metallic strips which are disposed between the surfaces of the strands which oppose each other to prevent the strands from contacting each other while leaving the surfaces of the strands which define the outside diameter of the cable exposed, comprising:

a cable twisting head; and guiding plates disposed in front of said cable twisting head, each of which guides one of said strips to said cable twisting head, and onto one of said strands, said guide plates having a shape which substantially corresponds to the shape of the opposing surface of the strand on which the strip guided thereby is placed.

13. The device according to claim 12, wherein the distance between said guiding plates and said cable twisting head is between 20 to 150 mm.

14. The device according to claim 12, wherein the number of said guiding plates is the same as the number of said strips.

15. The device according to claim 12, wherein said guiding plates have leading edge areas which are configured to surround the edges of said strips.

* * * * *